United States Patent [19]

Canfield

[11] 4,164,177

[45] Aug. 14, 1979

[54] METHODS AND APPARATUS FOR ROLLING MATERIAL INTO A PACKAGE

[75] Inventor: Sheldon A. Canfield, Newark, Ohio

[73] Assignee: Owens-Corning Fiberglas Corporation, Toledo, Ohio

[21] Appl. No.: 940,225

[22] Filed: Sep. 7, 1978

[51] Int. Cl.[2] ..... B30B 13/00; B30B 5/06

[52] U.S. Cl. ..... 100/40; 53/118; 100/88; 242/55

[58] Field of Search ..... 242/55, 67.1 R, DIG. 3; 100/5, 40, 87, 88; 53/118

[56] References Cited

U.S. PATENT DOCUMENTS

| | | | |
|---|---|---|---|
| 2,096,990 | 10/1937 | Luebben | 100/88 |
| 3,911,641 | 10/1973 | Miller | 100/87 |
| 3,964,235 | 6/1976 | Miller | 53/118 |
| 4,114,530 | 9/1978 | Miller | 100/87 |

*Primary Examiner*—Edward J. McCarthy

*Attorney, Agent, or Firm*—Ronald C. Hudgens; Charles F. Schroeder; Joel I. Rosenblatt

[57] ABSTRACT

A flat compressible material is roll-formed into a cylindrical package by a belt drive. The diameter of the rolled package is controlled so that a fixed predetermined length of material forms a rolled package of a predetermined diameter. The length of belt drive in contact with the material is proportionate to the length of the material fed into the belt drive, and holds the finished package size to a predetermined diameter.

32 Claims, 3 Drawing Figures

METHODS AND APPARATUS FOR ROLLING MATERIAL INTO A PACKAGE

FIELD OF THE INVENTION

This invention relates to the field of rolling materials into cylindrical rolled packages.

BACKGROUND OF THE INVENTION

The prior art shows a flat material fed into a belt which drives the material into a rolled package, and wherein the package is of a spiral cross section. See for example, U.S. Pat. Nos. 3,964,235 and 3,911,641. The belt drive wraps around the rolled package and engages the outside surface of the material. The object of the packaging device is to wind the rolled package spiral as tight as practicle so that the finished package takes up the least volume. One common method of ensuring a tight spiral within the rolled package is to maintain the tension of the belt to compress the material as it is fed into the packaging machinery. However, this method does not offer any direct correlation between the tension applied and the size of the package as it grows, reaching its final diameter.

SUMMARY OF THE INVENTION

A material such as fibrous glass insulation is inserted into a packaging means which utilizes a belt drive member. The belt member wraps around the outside of the material and about the package in its finished state. The length of the drive belt in contact with the package provides a direct correlation to the diameter of the package. The belt, wrapped about the package in contact with at least part of the package, is directly related to the circumference of the package which, in turn, has a direct relationship to the diameter of the package.

In this invention, the length of the belt is controlled as the material is fed into the machine, so that the package reaches its final predetermined diameter at the time the end of the material enters the machine and forms part of the package. The length of the belt is allowed to grow as the material is fed into the machine by a means which places the belt drive into contact with the material at a faster rate then it removes the drive belt from the material. The means may be controlled so that it places the belt into contact with the material at a first rate and removes the belt from contact with the material at a second rate, without using a feedback loop. The material may be a compressible fibrous glass material.

The second means employed uses sensors, providing signals indicative of the rate the belt enters into contact with the material and disengages from the material. These signals are then fed to a controller which controls the means driving the belt into and out of contact with the packaging material through a feedback loop.

The elongation of the belt drive may be at either a linear or nonlinear rate with respect to time or the rate of material feed. Appropriate sensors and controls, as is known in the art, may be added for purpose and to detect the end of the material as it enters the machine, so the drive may be terminated and the finished package released.

The principles of this invention may be applied to any known belt roll-up machine such as that shown in U.S. Pat. No. 3,911,641 but are not limited to the roll-up machine shown in that patent.

DESCRIPTION OF THE PREFERRED EMBODIMENT

With reference to the foregoing drawings, the preferred embodiment of the invention is now described.

Figure 1:
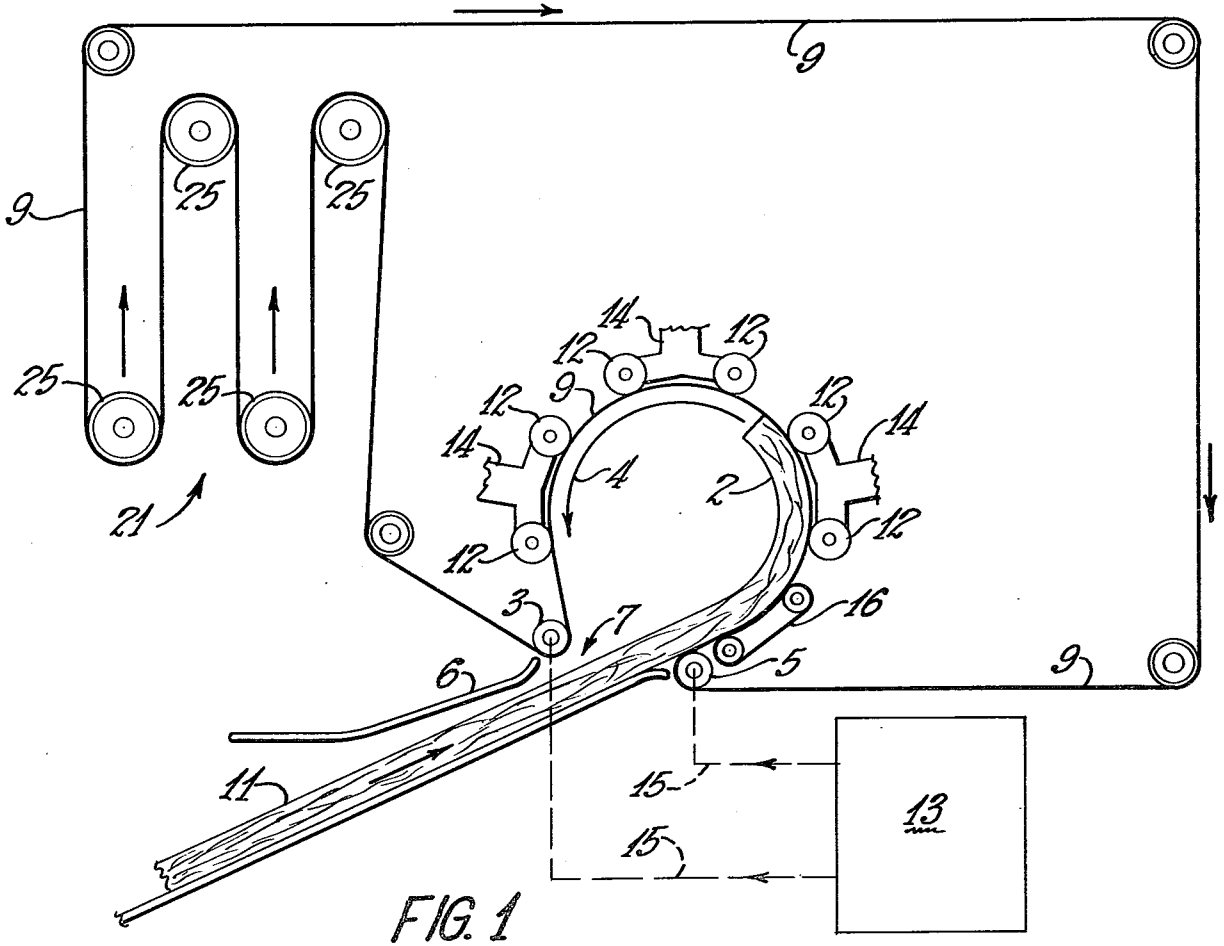
FIG. 1 shows a packaging machine for rolling the material into a cylindrical package having a spiral cross section and is generally the manner of using this invention.

As shown in FIG. 1, the machine contains two rollers, a first roller 3 and a second roller 5 forming an opening 7 between the two rollers. The belt 9 is shown driven by a roller 3 and 5. A driving force, not shown, is applied to each of the rollers, as is known in the art. The belt 9 may be a continuous flexible material, organic or inorganic, or may be a metal belt such as a wick wire chain belt or may be any other belt made of sections connected to function as a belt.

In use, a material 11 is inserted in opening 7 between the rollers and against the belt. The belt loop shown in FIG. 1 represents the smallest length of loop between the two rollers, commensurate with the start of the process when the material is first inserted into the machine. Guide 6 directs the front edge of the material into engagement with the belt 9 to start the winding process shown by arrow 4 and as shown in U.S. Pat. No. 3,911,641.

As is known in the art, the material entering the machine, against the force of the belt engages the belt and is forced into an initial loop 2, and the following material is wrapped around that initial portion into the spiral shown by arrow 4 until a finished cylindrical rolled package is completed.

A means 13 for controlling the drive rollers 3 and 5 is connected to drive rollers 3 and 5, and is capable of driving the rollers at a differential rate.

The controller 13 is shown connected to roller 3 and roller 5 by dashed lines 15. These dashed lines represent control connections to the driver motors (not shown) for the rollers 3 and 5. The controller may be any controller known in the art and may be an analog or digital controller.

Controller 13 is programmed to drive rollers 3 and 5 at differential rates with roller 3 being retarded relative to the rate of roller 5. In this way, the belt length between roller 3 and 5 is gradually increased commensurate with the amount of material fed into the roll-up machine through opening 7.

In this and subsequent embodiments, a delay may be built into the roller drivers for rollers 3 and 5 to allow the material 11 to compress a predetermined amount before the roll is allowed to grow in diameter.

Controller 13 may be programmed to drive the belts through the rollers 3 and 5 by a pre-established time function or relative to the rate the material 11 is fed into the roll-up machine drive belt. For example, allowing for the compression of the material 11 in the roll, the controller 13 may be programmed to terminate the drive belt 9 and release the rolled material from the machine a given period of time after the beginning of the material 11 is inserted into the opening 7. Alternatively, the controller 13 may be programmed to stop the belt drive and release the material from the machine upon the belt reaching the pre-determined length between the rollers 3 and 5. For this purpose, an appropriate limit switch may be provided to sense the diameter of the belt and release the rolled material from the machine when the roll reaches the pre-determined diameter.

The controller may also delay the growth of the package after the material is engaged with the belt, to compress the material an initial amount before the diameter of the package is allowed to grow. This delay may be used in all the embodiments shown according to the principles of this invention.

The support rolls 12 shown displaced around the outside of the belt driver mounted in pairs may be mounted resiliently against the outside of the belt to force it against the material 11 and to maintain the tension of the belt against the material as shown in U.S. Pat. No. 3,911,641. Appropriate detectors may be connected to the roller supports 14 to provide a signal to controller 13 to stop the belt drive and release the rolled material from a machine at the appropriate diameter limit. The mounting of such sensors and using such sensors is known and is not explained in detail.

Additionally, the differential rate of the two rollers 3 and 5 may be so controlled to increase the length of belt 9 therebetween so that the rate of growth of belt length between the rollers 3 and 5 is linear or nonlinear in respect to either the amount of material 11 fed into the machine through opening 7 or the point in time after the material is initially inserted into the machine.

Appropriate sensors which may be used are either timers or tachometers, or light sensors responsive to timing marks on a conveyor moving the material 11 into the roll-up machine.

Support belt 16 is shown displaced on the circumference of the belt, approximately where the material 11 engages the belt, to provide additional support for the belt at that location.

A belt supply reservoir is shown generally at 21 and includes rollers 25. The belt 9 is driven about rollers 25. The rollers 25 are shown in their extreme positions at the start of the roll-up process to store a maximum amount of belt. As material 11 is fed into the roller machine through opening 7, and the amount of belt in the loop increases, the rollers 25 are moved towards each other in a direction of the arrows to diminish the amount of belt in the reservoir and supply additional belt to the loop. This process is substantially shown within U.S. Pat. No. 3,911,641.

In the case of the embodiment shown in FIG. 1, the means for controlling 13 may be programmed to drive the rollers 3 and 5 at a differential rate, either linearly or nonlinearly in response to the time the material 11 is inserted into the machine through opening 7 and in response to the duration of time from the insertion of the material through the opening 7 or in response to the length of material fed to the machine.

Figure 2:
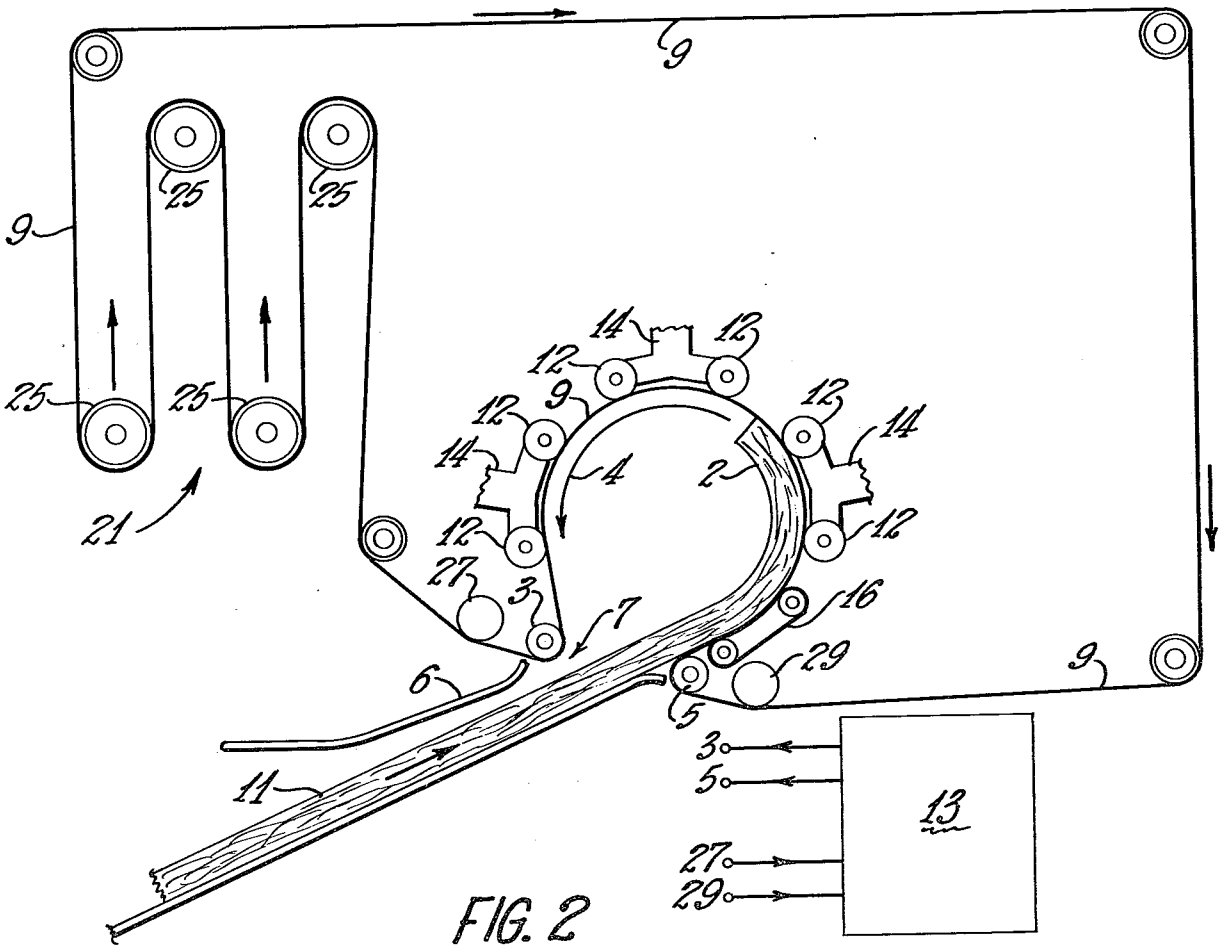
FIG. 2 shows substantially the device of FIG. 1 with an alternate embodiment using this invention.

An alternate embodiment is shown in FIG. 2.

The drawing in FIG. 2 is substantially that of FIG. 1, with the same material used to show substantially the same and similarly operating parts.

As shown in FIG. 2, means are provided for sensing the rate the belt enters into contact with disengages from the material. These sensors are shown in FIG. 2 as tachometers 27 and 29 in contact with the belt, with tachometer 29 in advance of drive roller 5 and tachometer 27 behind the drive roller 3 relative to belt travel. The tachometers may be replaced by other sensors known in the art to obtain the speed information of the belt. These sensors, for example, may be radiation actuated, such as a light responsive to a timing mark on the belt, or doppler detectors.

The means for controlling 13 is shown with drive signals directed outwardly to the drive means for drive rollers 3 and 5 (not shown) and with input signals from the tachometers 27 and 29. The means for controlling the roll-up machine 13 may either be analog or a digital programmed controller, as is well known.

Figure 3:
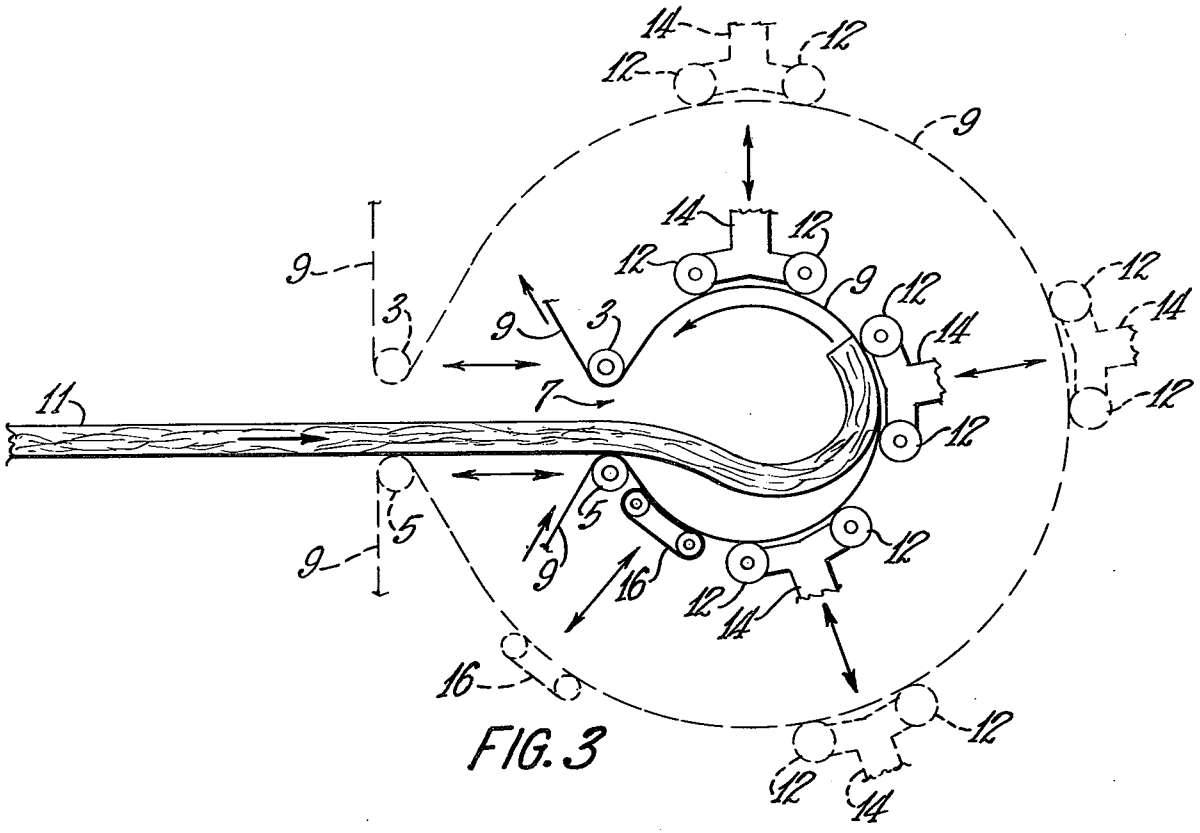
FIG. 3 shows in partial form, the device of FIG. 1 with another alternate embodiment.

A third embodiment is shown in FIG. 3. A portion of the operating parts shown in FIG. 1 and FIG. 2 are not shown in FIG. 3 but are understood to be included in FIG. 3. As shown in FIG. 3, material 11 inserted into the roll-up machine, and as the diameter of the rolled material grows, the drive rollers 5 and 3, as well as the tensioning rollers 12 placed around the periphery of the belt support roller 13, are moved radially outwardly from their initial positions to accommodate the growing diameter of the rolled package. This movement may be accommodated mechanically by positively moving the tensioning rollers, the support belt and the drive rollers outward or by urging the drive rollers, tensioning rollers and support belt against the belt by resilient means and using the rolled package to force these components radially outwardly as the package grows. The drive rollers 3 and 5 would move with their attached respective driving means (not shown).

As is in the embodiment shown in FIG. 1, the movement of the rollers to accommodate the increased diameter of the rolled package can be done either nonlinearly or linearly in respect to a time the material is first inserted into the machine or the length of material that is fed into the machine.

A means 13 (not shown) may be used in this embodiment as an embodiment of FIGS. 1 and 2 to control movement of the rollers outwardly from their initial positions. In this connection a pre-programmed function may be used by the controller to move the drive rollers at a predetermined, precalculated rate or in response to time or the length of material fed into the machine, or the differential rate of the drive rollers 3 and 5.

The control 13 would then initiate a signal terminating the rolling process when such a time had elapsed that the belt length within the loop corresponded to the desired diameter.

In the embodiment of FIGS. 1 and 2, the means 13 drives roller 3 at a relatively slower rate than it drives roller 5, and the length of the belt forming the loop between rollers 3 and 5 is gradually increased proportionate to the amount of material 11 fed to the belt 9 through opening 7.

The length of the belt shown between rollers 3 and 5 is used as representative of the circumference of the package at any moment of time in the packaging process. The belt need not be completely around the package as long as the length of the belt can be related to the circumference of the finished package. Typically, the belt length will be less than the full circumference of the package and the diameter of the finished package may be computed from the belt length by using an appropriate constant less than one.

Using a constant as appropriate, the diameter of the package, when completed, will be equal to KA (the length of the belt about the finished package) divided by $\pi$(KA$\pi$).

The calculation for controlling the process according to the embodiments of FIGS. 1, 2, and 3 are described below.

The calculations which are performed by the controller 13 are shown for the following cases.

Case 1—FIG. 1 elongation of the belt within the loop as a predetermined function is shown by the expression:

$$R_5 = K_1 t_n$$

$$R_3 = K_2 t_n \quad (1)$$

where $R_5$ and $R_3$ are the rates of the drive rollers 5 and 3 and $K_1$ and $K_2$ are constants with $K_1 > K_2$ and $t_n$ is the time elapsed from the insertion of the material into engagement with the belt.

The calculation for Case 1 may also be nonlinear with respect to time or may be a discontinuous function as required by the material or the process machinery.

Alternatively, the above calculation may be made dependent upon the length of material placed into contact with the belt as shown by the expression:

$$R_5 = K_3 R_m(tn)$$

$$R_3 = K_4 R_m(tn) \quad (2)$$

where $R_m$ is the rate of material feed.

Case 2—FIG. 2 elongation of the belt within the loop using a feedback loop and with speed indicated by the sensors may be expressed as:

$$R_{5tn+1} = K_5(S_5 - S_3)tn$$

$$R_{3tn+1} = K_3(S_5 - S_3)tn \quad (3)$$

where $S_3$ and $S_5$ are the rates of the sensors at the time tn and $R_{5tn+1}$, $R_{3tn+1}$ are the new rates for drive rollers at the next successive time interval or clock pulse tn+1.

The rate of rollers 5 and 3 as in Case 1 above may be a linear or nonlinear function of time, or the length of material feed ($R_m$). In this case the expression of equation (3) substituting $R_m$ the rate of material feed.

$$R_{5tn+1} = K_7(S_5 - S_3)R_m(tn)$$

$$R_{3tn+1} = K_8(S_5 - S_3)R_m(tn) \quad (4)$$

Case 3,—FIG. 3, Elongation of the belt within the loop by moving the rollers radially outward may be expressed as:

$$D_{5tn+1} = K_9 K_1 tn$$

$$D_{6tn+1} = K_9 K_1 tn \quad (5)$$

where $K_9$ is a constant and $K_1$tn represents the belt loop circumference at time tn and $D_{5tn+1}$, $D_6$tn+1 are the required displacement of the roller at the next successive time interval tn+1. In this case $K_9$ is the appropriate constant which provides the circumference of the belt in the loop as a linear function of time. Accordingly, as in equations (1) to (4) the equation (5) may be made to vary linearly or nonlinearly to represent the time or with the length of material fed into the machine.

I claim:

1. A method for controlling the diameter of a rolled package of compressible mat material comprising the steps of feeding said material into engagement with a belt moving along a path defined by its length, said belt defining a roll-confining collection region for rolling said material into a package and from which said package is subsequently released, controlling the rate of said belt upon engagement of the said material with the belt and upon disengagement from said belt at the collection region, controllably altering the said rates of engagement and disengagement of said belt with the said material from the time of engagement of the said material with the said belt, determining when the said rolled package has reached a predetermined size and releasing the said package from the said collection region whereby a desired size rolled package is produced.

2. The method of claim 1 wherein said step of altering includes the step of retarding the rate the said belt disengages the rolled package in relation to the rate the said belt engages said package to increase the length of belt in contact with the said package.

3. The method of claim 2 wherein said step of altering includes the step of delaying the said altering to permit the material to compress within the belt before the diameter of the package is allowed to expand.

4. The method of claim 2 including the step of delaying the said step of altering, after the said step of engaging, the material with the belt.

5. The method of claim 2 wherein said step of altering includes the step of sensing the said rates the package engages said belt and disengages said belt, and said step of retarding the belt rate leaving the package includes the step of retarding said rate in proportion to the rate said material enters in contact with said roll, to increase the diameter of the roll at a controlled rate proportionate to the length of said material placed into contact with said belt.

6. The method of claim 5 wherein including the step of sensing the diameter of the roll and terminating said belt when said package reaches a predetermined diameter.

7. The method of claim 6 wherein said step of sensing includes the step of sensing the rate said belt engages the material and said rate said belt disengages said material to calculate the length of said belt in contact with said packge.

8. The method of claim 7 wherein said step of calculating includes the step of subtracting the rate of material disengaes the belt from the rate of material engages the belt, and multiplying the result by the time elapsed from the time that the material engaged the belt.

9. The method of claim 8 including the step of disengaging the drive belt when calculated belt length corresponds to a predetermined rolled package diameter.

10. The method of claim 7 where said predetermined diameter is substantially the belt length multiplied by K and K is a constant less than one.

11. The method of claim 2 wherein the speed of said belt and said rate of said belt engaging the material and said rate of said belt disengaging said material is altered in accordance with a pre-established function.

12. The method of claim 11 wherein said pre-established function increases said belt length with respect to the length of said material placed into contact with said belt.

13. The method of claim 11 wherein said predetermined function increases the length of said belt nonlinearly with respect to the length of said material placed into contact with said belt.

14. An apparatus for controlling the diameter of a rolled package of compressible mat material comprising a belt, said belt having a portion defining a roll collection region, means for moving said belt along a path defined by its length, means for feeding said material into engagement with said belt, means for engaging said belt with said material and means for disengaging said belt from said material at the collection region, means for controllably altering the rates said belt engages said material and disengages from said material from the time said material is fed into engagement with said belt, means for determining when the said rolled package has reached a predetermined size, and means for releasing said package whereby a desired size rolled package is produced.

15. The apparatus of claim 14 wherein said means for altering includes means for delaying the said means for altering to permit the material to compress within the belt before the diameter of the package is allowed to expand.

16. The apparatus of claim 14 including means to delay the said means for altering.

17. The apparatus of claim 14 wherein said means for engagement is a first driver roller, said means for disengagement is a second driver roller, and means for altering being connected to the first driver roller and to the second driver roller for driving said rollers at a differential rate to increase the length of belt between said engagement point and disengagement point and the diameter of said roll proportionately.

18. The apparatus of claim 14 wherein said driver rollers means are displaced from said points of engagement and disengagement of said material from the driver roll.

19. The apparatus of claim 14 wherein said driver roll surrounds the rolled package and with the diameter said rolled package being proportionate to the length of said belt.

20. The apparatus of claim 16 including means for controlling the rates of said first and second driver rollers, to increase the length of said belt with respect to the rate said material engages said roller.

21. The apparatus of claim 20 wherein said rate of increase of length of said belt is linear with respect to the rate material engages said belt.

22. The apparatus of claim 20 wherein said rate of increase of length of said belt is nonlinear with respect to the rate said material engages said belt.

23. The apparatus of claim 20 including means for sensing the diameter of said roll and terminating said driver means for driving said belt.

24. The apparatus of claim 14 wherein said means for altering is a controller, said means for driving said belt includes sensors providing signals indicative of the speed of said belt into engagement and out of engagement of the said material, said controller having means for calculating the length of said belt in engagement relative to the said sensor signals.

25. An apparatus of claim 24 wherein said controller alters the length of said belt between said points of engagement and disengagement to control the diameter of said package, responsive to said calculated length.

26. The apparatus of claim 25 wherein said controller increases the length of said belt linearly with respect to the rate said material engages the belt.

27. The apparatus of claim 22 wherein said controller increases the length of said belt nonlinearly with respect to the rate said material engages the belt.

28. An apparatus for controlling the diameter of a rolled package of compressible mat material comprising a belt, said belt having a portion defining a roll collection region, means for feeding said material into engagement with the said belt, roll collection region means for engaging the said material with the said belt at a first region, means for disengaging the said material from said belt at a second region, means for controllably displacing the said means for engaging and disengaging in a radially outward direction from the time said material is fed into said belt, means for determining when said package has reached a predetermined size and means for releasing said package from said belt whereby a desired rolled package is produced.

29. The apparatus of claim 28 including means for delaying the said means for displacing.

30. The apparatus of claim 28 wherein said means for engaging and disengaging are displaced linearly with respect to the length of material engaging said belt.

31. The apparatus of claim 28 wherein said means for engaging and disengaging are displaced nonlinearly with respect to the length of said material engaging said belt.

32. The apparatus of claim 31 wherein said means for engaging and disengaging are drive rollers.

* * * * *